US005696334A

United States Patent [19]

Terry

[11] Patent Number: 5,696,334

[45] Date of Patent: Dec. 9, 1997

[54] MULTI-ACTION DEVICE FOR CONTROLLED CORRECTION OF BOWING IN THE NECK OF A STRINGED MUSICAL INSTRUMENT

[75] Inventor: Aurthor C. Terry, Rte. 2 Box 320A, Ada, Okla. 74820

[73] Assignee: Aurthor C. Terry, Ada, Okla.

[21] Appl. No.: 698,733

[22] Filed: Aug. 16, 1996

[51] Int. Cl.[6] ..... G10D 3/00

[52] U.S. Cl. ..... 84/293; 84/267

[58] Field of Search ..... 84/267, 293

[56] References Cited

U.S. PATENT DOCUMENTS 5,465,642 11/1995 Goto ..... 84/293

*Primary Examiner*—Michael L. Gellner
*Assistant Examiner*—Shih-yung Hsieh

[57] ABSTRACT

This invention is a multi-action device for controlled correction of bowing in the neck of a stringed musical instrument. It comprises a ridged metal bar main frame immediately under the fingerboard and running lengthwise and on centerline. Primary adjustment is made by applying pressure directly to the end of the main frame at the heel end of the neck. Secondary adjustment is made by applying pressure to an eyelet affixed on the bottom side of and on the heel end of the main frame. The adjusting nut for secondary adjustment is on the threaded end of an anchor rod that passes through the eyelet with the other end of the rod welded to a predetermined location on the underside of the main frame. An alternate to the anchor rod is an anchor stud mounted in the heel end of the neck and passing through the eyelet. Primary and secondary adjustments are the same as for when the rod is used. Further control can be exercised by prestressing, slotting, and/or establishing pressure points on end of the main frame.

5 Claims, 4 Drawing Sheets

Detail 2a
Detail 2b
Detail 2c
46
48
38
40
32
44
62
22
42
50
36
24
30
52
54
34
26

MULTI-ACTION DEVICE FOR CONTROLLED CORRECTION OF BOWING IN THE NECK OF A STRINGED MUSICAL INSTRUMENT

BACKGROUND

This invention relates to stringed musical instruments, specifically to the reinforcing of the neck against bowing.

PRIOR ART

A stringed musical instrument comprises a main body for sound amplification, a neck to support the fingerboard, and one or more strings. The most negatively affected member of the instrument is the neck. The primary problem with the neck is the tendency for it to bow in a concave manner when the strings are tensioned up to desired musical pitch. There is a frustration factor for a musician in playing on a neck that is excessively bowed and/or bulky. This frustration can be distracting and some maneuvers and positions that can be accomplished on a smaller and straighter neck are difficult or impossible. Several devices have been designed to correct this problem. Most of them offer some degree of correction but still are inadequate to correct a neck of preferred small size.

When a traditional truss rod is used to pull the neck back to corrected position it must have about the same amount of tension as that of the strings. Therefore, the longitudinal pressure on the neck is effectively doubled. Under such pressure the neck must necessarily be bulky in size to avoid buckling. This requires a neck that is larger in size than what is desirable.

A neck with parallel rods is also less than desirable because the parallel rods will basically just bow together. When tension is applied to the truss rod it will in fact cause its parallel counterpart to be thrust awayward and offering some degree of correction against the bowing of the neck. In this arrangement the point in the neck that has the most curve is the point that has the most pressure. This pressure point is sufficient to "chase" away the corrective action of the counterpart at this point. Therefore the action and reaction of this device are unpredictable. When spacer(s) are used between the two parallel elements to selectively establish counterpressure points and the counterpart becomes generally straight then the spacer that is closest to the heel portion of the neck has displaced the truss rod at this point to a location below the original parallel configuration. Now the portion of the truss rod from this point to where it connects to the end of its counterpart toward the heel is no longer parallel. This portion of truss rod is now pulling in an angular direction that is negative to the corrective requirements. This area of the neck must be especially bulky because it is not only bearing the pressure from the string tension but also that of a portion of the truss rod that is pulling in a negative direction. This necessitates a neck that is larger in size than what is desirable.

A neck with a curved truss rod has problems similar to those mentioned in the previous paragraph. Even though it performs well in theory, in practice the most leverage is still at the point in the neck just before it graduates into the heel. At the point where the curved truss rod begins to turn bask upward toward the heel end it begins to pull in a direction that is negative to the corrective requirements in this most critical area plus the pressure caused by the string tension. Bowing resistance in this area relies entirely upon the rigidity of the neck necessitating a larger neck size than what is desirable.

OBJECTS AND ADVANTAGES

The objects and advantages of this invention are to produce a multi-action device for controlled correction of bowing in the neck of a stringed musical instrument facilitating the construction of an extraordinarily slim neck and maintaining the desired degree of straightness.

When both ends of a body of wood with rectangular cross-section and sufficient length are pulled together so as to shorten the distance between the two ends the body of wood forms a bow (curve) that is hyperbolic in configuration. This means that there is leverage that begins at each end of the wood body. As the distance increases from each end the leverage also increases. Because of the increasing leverage the intensity of the bowing also increases from each end until the two leverage forces meet at midpoint of the bar. At this midpoint between the two ends the intensity of bowing is at its maximum. This point is known as the apex of the hyperbolic curve.

Traditional necks necessarily must increase in size as they progress from the peghead end due to inadequate geometric design in reinforcement. For this reason the bow in the unadjusted traditional neck tends to be more constant. The neck that this new device is designed to correct is relatively small in cross-sectional size and tends to be more constant in size from one end to the other. For this reason the bow in this neck is more hyperbolic in configuration when not adjusted than that of the traditional neck for reasons explained in the previous paragraph. The apex is at the point closest to the heel of the neck and diminishes as the neck size graduates into the heel. This is why a multi-action device for controlled correction of bowing in the neck of a stringed musical instrument is necessary.

This new device comprises a main frame of rigid metal with an eyelet on one side of one end. The main frame is fitted into a channel immediately under the fingerboard and on centerline of the neck fitting snugly on all sides. The eyelet is now at the heel end of the neck and on the underside of the main frame. A compressor assembly for applying pressure to the heel end of the main frame is installed on the heel end of the neck. Primary adjustment is made when pressure is applied at this location. When pressure is applied to the end of the main frame the action is shifted to the distal end of the neck. The reaction is that the distal end of the neck is pushed back into corrected position. This action corrects the distal end of the neck back to a point. At some point from the distal end of the neck the increasing leverage tends to overcome the corrective action of the pressure that is on the main frame. At about this point the end of an anchor rod is attached to the underside of the main frame in line with the eyelet. The other end of the anchor rod goes through the eyelet with an adjusting nut installed for applying pressure from the end of the anchor rod to the eyelet. This anchor rod is angular with respect to the main frame from the point where it is attached and increases in distance from the main frame as it passes through the eyelet.

Secondary correction is made when pressure is applied with the adjusting nut from the end of the anchor rod to the eyelet. When pressure is applied the eyelet tends to rotate upward and toward the distal end. This rotation develops a concentrated upthrust in the main frame greatly increasing the rigidity in the apex area and pushes out any remaining bowing.

An alternate to the anchor rod is an anchor stud that is mounted into the heel of the neck in line with and passing through the eyelet. An adjusting nut is installed on the end of the anchor stud for applying pressure from the stud to the eyelet. Primary and secondary adjustments are made on the alternate device in the same manner as those in the previously described device. Additional control of location, direction, and magnitude of corrective deflection of the main frame can be initiated by pre-stressing, slotting, and/or the locating of pressure points on the ends of the main frame or the deflection bumper. Whether the primary or alternate embodiment is most preferred depends on the relative length and cross-sectional size of the neck construction. Either device is finally installed after the neck construction is complete therefore making it possible and convenient to remove the device for maintenance, repair, adjustment, and replacement. The construction of this device is simple, inexpensive, and made from simple components.

A BRIEF DESCRIPTION OF THE DRAWINGS

LIST OF REFERENCE NUMERALS

Figure 1:
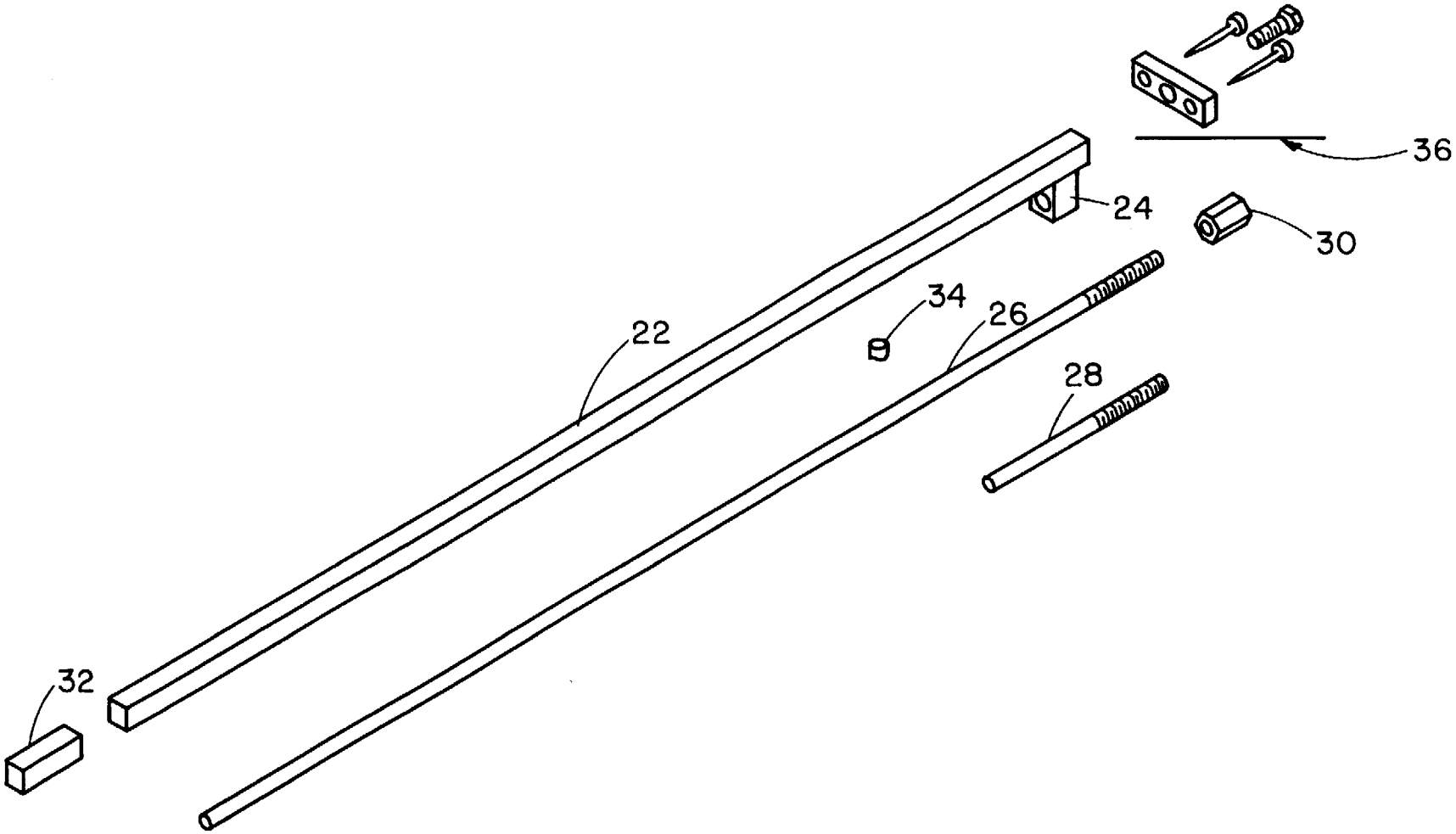
FIG. 1 is an exploded pictorial view of a multi-action device for controlled correction of bowing in the neck of a stringed instrument.

22. Main frame
24. Eyelet
26. Anchor rod
28. Anchor stud
30. Adjusting nut
32. Deflection bumper
34. Shim
36. Compressor assembly
38. Neck
40. Heel end of neck
42. Fingerboard
44. Direction of action
46. Direction of leverage
48. Direction of string tension
50. Tangent point
52. Direction of rotation of eyelet
54. Direction of upthrust of main frame
56. Direction of pre-stressing
58. Slotting
60. Locating pressure points
62. Distal end of neck

SUMMARY

The object of this invention is a device that is installed in a longitudinal direction within the neck of a stringed musical instrument. The neck that is in consideration is for guitar with any plurality of strings and of any string gage. This neck is extraordinarily small in size and is more uniform in width and thickness that those of traditional design. For this reason it is necessary to have a multi-action device for controlled correction of bowing. This device comprises a main frame of sufficient stiffness and size so as to resist buckling under a prescribed mount of end pressure. An eyelet is welded to one end and on one side of the main frame with the eyelet hole running generally parallel to the main frame. When this assembly is installed in a channel in the top side of the neck immediately under the fingerboard the eyelet is at the heel end of the neck and on the under side.

Primary adjustment is made when pressure is applied directly to the end of the main frame at the heel end of the neck. This pressure reacts on the distal end of the neck straightening a portion thereof from the distal end. Because of the increasing leverage as it progresses from the distal end the corrective action of the primary adjustment on the main frame is overcome. Where the now straight distal end meets with the still yet curved portion of the neck a point of tangency is developed. When this point is determined one end of an anchor rod is welded to the main frame at about this point on the underside. The anchor rod is angular with respect to the main frame increasing in distance from the main frame as the other end passes through the eyelet. An adjusting nut for applying pressure from the anchor rod to the eyelet is installed on the end of the rod.

Secondary adjustment is made when pressure is applied from the adjusting nut to the eyelet. This pressure tends to rotate the eyelet and respective end of the main frame in an upward and toward the distal end direction. This induces a concentrated upthrust in this portion of the main frame where the leverage from the string tension is greatest and pushes out any remaining bowing. At this stage of correction if any bowing still should persist it is ultimately corrected by the use of shim(s) at prescribed point(s) between the main frame and the anchor rod. Because of the triangular configuration between the main frame and the anchor rod the anchor rod is not displaced therefore it continues to pull in a direction that is positive to correction. The primary and secondary adjustments make possible the construction of a tandem action correction device. An alternate to the anchor rod is an anchor stud that mounts into the heel of the neck in line with and passing through the eyelet. An adjusting nut is installed on the end of the anchor stud for applying pressure from the stud to the eyelet. Primary and secondary adjustments are made on the alternative device in the same manner as those in the previously described device.

Further correction is made if and when necessary by pre-stressing, slotting, and/or cutting or filing selected pressure points on the end of the main frame or the deflection bumper. Further corrective deflection is initiated at chosen point(s) by using any combination of these methods when the primary adjustment is made on the main frame.

Whether the primary or alternate embodiment is most preferred depends on the relative length and cross-sectional size of the neck construction. Either device is finally installed after the neck construction is complete therefore making in possible and convenient to remove the device for maintenance, adjustment, and repair.

In consideration of the numerous adjusting capabilities in a single unit a multi-action device for controlled correction of bowing in the neck of a stringed musical instrument now exists. This correction system is sufficiently effective, versatile, and slim in profile so as to make possible the construction of an extraordinarily slim neck that will hold desired adjustments. It is simple to construct and the required building materials are inexpensive.

DESCRIPTION OF THE INVENTION

FIG. 1 shows an exploded view of a multi-action device for controlled correction of bowing in the neck of a stringed musical instrument. The main frame 22 is the main body of the assembly. The eyelet 24 is welded to the main frame 22 at one end on bottom side. The hole in the eyelet 24 is generally parallel to the main frame 22. One end of the anchor rod 26 is welded to the underside of the main frame 22 after the other end is first positioned through the eyelet 24. The anchor stud 28 is an alternate to the anchor rod 26. An adjusting nut 30 for applying pressure from the anchor rod 26 or anchor stud 28 to the eyelet 24 is installed on the end of the anchor rod 26 or the anchor stud 28. The deflection bumper 32 is positioned in line with and at the end of the main frame 22. A shim(s) 34 is for arbitrary locating and fitting between the main frame 22 and the anchor rod 26. A compressor assembly 36 for applying pressure directly to the end of the main frame 22 is installed in the heel of the neck.

OPERATION OF THE INVENTION, PRIMARY

Figure 2:
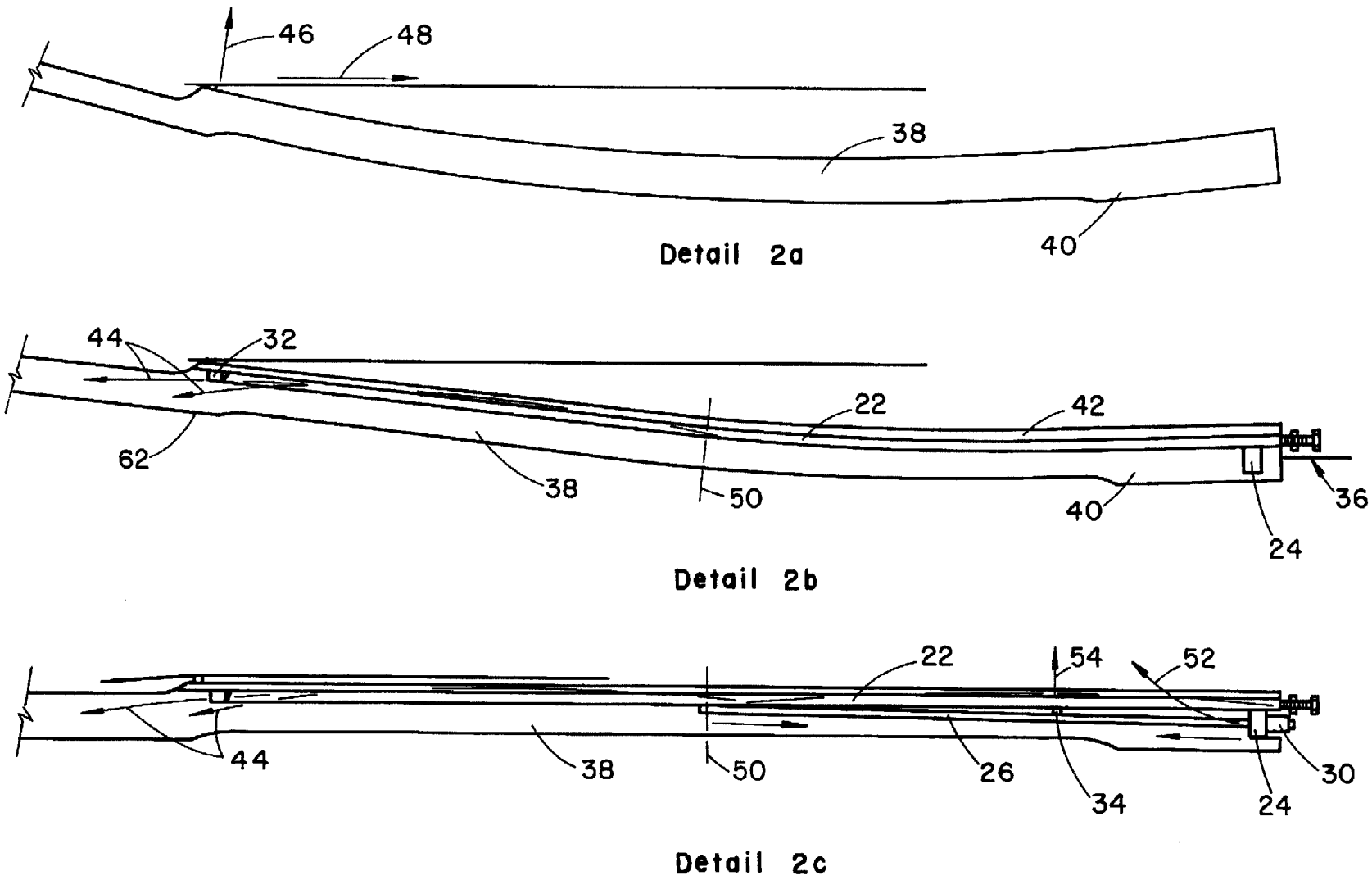
FIG. 2 is a side view of the multi-action device showing the progressive steps of assembling and correcting a bowed neck.

FIG. 2 shows that a main frame 22 is fitted into a channel immediately under the fingerboard 42 and is supported snugly on all sides, Det. 2*b*. The main frame 22 is solid or hollow and is constructed of a resilient metal. The main frame 22 is the anti-compression member that keeps the neck 38 from buckling. An eyelet 24 is welded to one end and on the underside of the main frame 22 and is positioned toward the heel 40 end of the neck 38. The hole in the eyelet 24 is generally parallel to the main frame 22.

Primary adjustment is made with a compressor assembly 36 by applying pressure from the heel 40 end of the neck 38 to the respective end of the main frame 22, Det. 2*b*. The action of the main frame 22 shifts to the distal end 62 of the neck 38 and results in the pushing of the distal end 62 of the neck 38 into a corrected position. This action will correct only a portion of the distal end 62 of the neck 38 before over-correcting occurs. As the leverage 46 increases from the string tension 48 as it progresses from the distal end 62 the corrective action of the main frame 22 is overcome. At the point where the corrected and straight distal end 62 meets the still yet bowed end a tangent point 50 is developed. When this point 50 is determined the anchor rod 26 is fitted and assembled in with one end passing through the eyelet 24 and the other end is welded to the underside of the main frame 22 at about the tangent point 50. The anchor rod 26 is angular with respect to the main frame 22 running from the point where it is welded and increasing in distance from the main frame 22 as it passes through the eyelet 24. An adjusting nut 30 for applying pressure from the anchor rod 26 to the eyelet 24 is installed on the end of the anchor rod 26.

Secondary adjustment is made when pressure is applied from the anchor rod 26 to the eyelet 24 with the adjusting nut 30, Det. 2*c*. When pressure is applied the eyelet 24 tends to rotate upward 52 and toward the distal end 62 and inducing a concentrated upthrust 54 in this area of the main frame 22. The upthrust 54 greatly strengthens this most critical area of the neck 38 and pushes out any remaining bowing.

Additional strengthening is incorporated by using a shim (s) 34 of selected thickness and location between the main frame 22 and the anchor rod 26. Since the anchor rod 26 runs in a predetermined angular direction with respect to the main frame 22 the corrective tension continues to be in a corrective direction.

Figure 4:
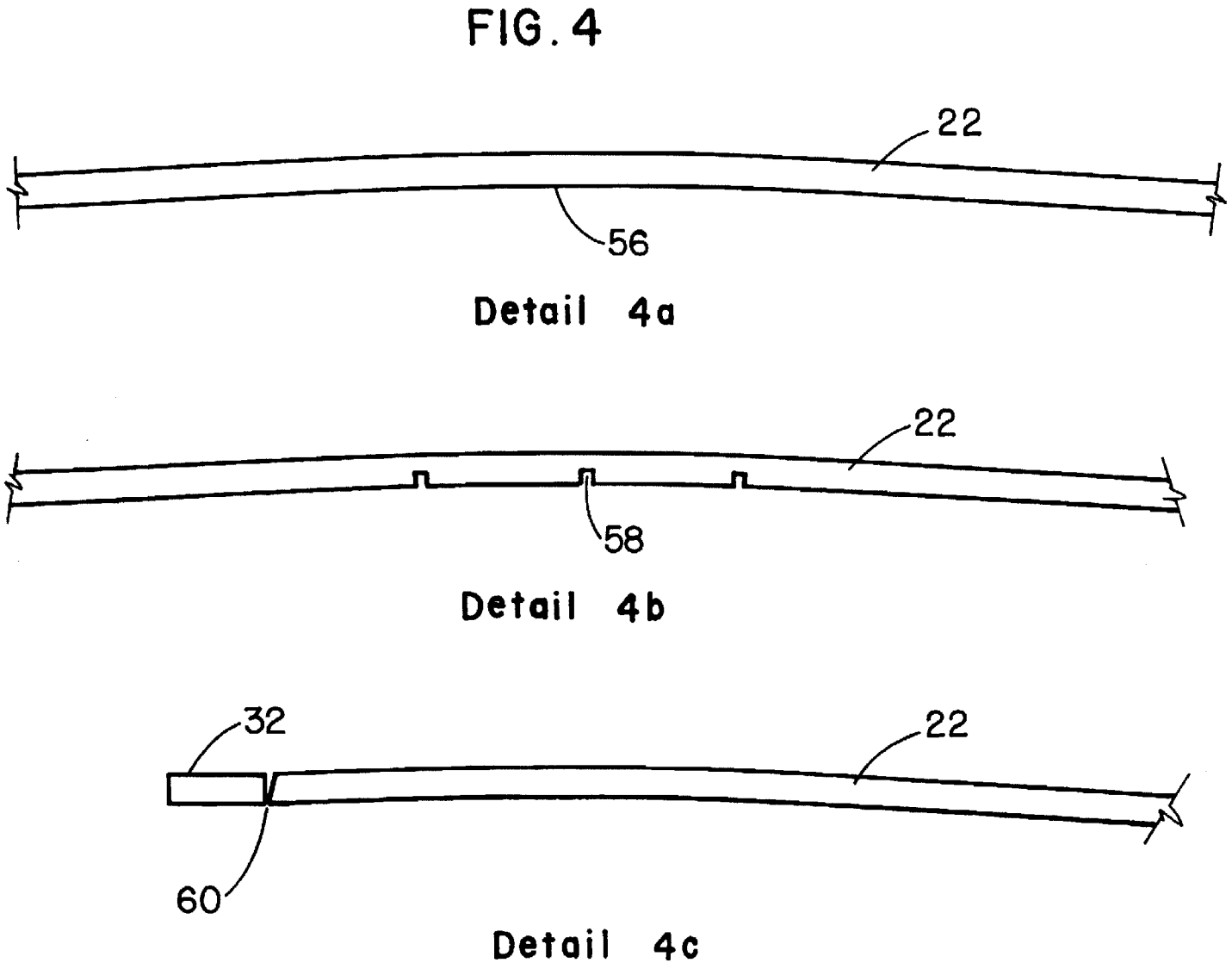
FIG. 4 is a side view of a portion of the main frame illustrating the use of pre-stressing, slotting, and locating of pressure points on the end of the main frame.

FIG. 4 illustrates how additional control of location, direction, and magnitude of corrective deflection of the main frame 22 is initiated by pre-stressing Det. 4*a*, slotting Det. 4*b*, and/or prescribed location of pressure points Det. 4*c*, on the end of the main frame 22 or the deflection bumper 32. Furthermore, any combination of methods Det. 4*a*, 4*b*, or 4*c* is used as is determined necessary.

ALTERNATIVE EMBODIMENTS

Figure 3:
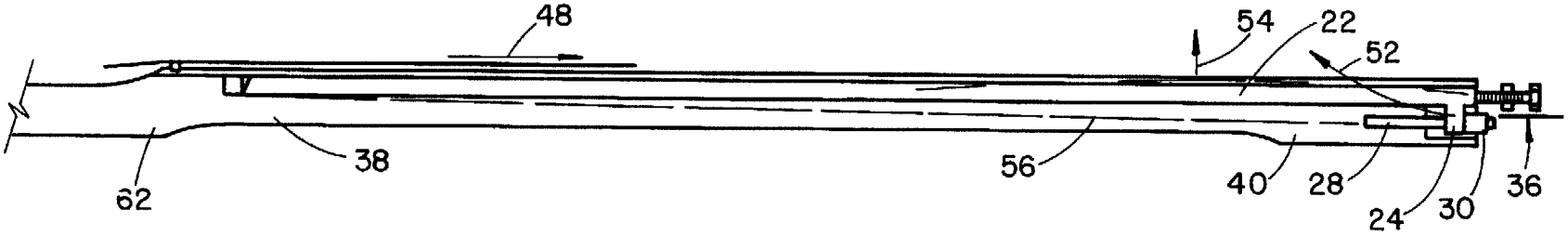
FIG. 3 is a side view of an alternate assembly.

FIG. 3 shows how the anchor stud 28 is used as an alternative to the anchor rod 26 FIG. 2. The anchor stud 28 is mounted into the heel 40 of the neck and passes through the eyelet 24. An adjusting nut 30 for applying pressure to the eyelet 24 is installed on the end of the anchor stud 28.

Primary adjustment is made by applying end pressure to the main frame 22 with the compressor assembly 36. Secondary adjustment is made on the main frame 22 when pressure is applied to the eyelet 24 with the adjusting nut 30. Tension develops in the bottom side of the neck between the mounted end of the anchor stud 28 and the distal end of the main frame 22. The principal line of tension 56 is angular with respect to the main frame 22 and runs well into the heel 40 portion of the neck. This tension becomes the corrective reaction that counteracts the string tension 48 toward the distal end 62 of the neck 38 as the rotational action 52 of the eyelet 24 induces a concentrated upthrust 54 in the respective end of the main frame 22. This greatly strengthens and corrects bowing in the area of the neck 38 that has the greatest amount of leverage.

FIG. 4 illustrates how additional control of location, direction, and magnitude of corrective deflection of the main frame 22 is initiated by pre-stressing Der. 4*a*, slotting Det. 4*b*, and/or prescribed location of pressure points Det. 4*c*, on the ends of the main frame 22 or the deflection bumper 32. Furthermore any combination of these methods is used as determined to be necessary.

The method of choice, primary or alternate, depends largely on the length and cross sectional size ratio of neck being constructed. Either method is used successfully in most necks of typical length, however longer necks have more restrictive requirements as to which method may be more suitable. Exact construction and design requirements of the correcting device are directly related to the corrective requirements of the neck that is under construction. Either corrective device, primary or alternate, is finally inserted into the neck after the neck is constructed therefore it is possible and convenient to remove the device for making adjustments, repairs or replacements.

What is claimed is:

1. A multi-action device for controlled correcting of bowing in a neck of a stringed musical instrument, said device comprising:

a main frame member of predetermined size and shape having sufficiently high degree of rigidity with parallel eyelet on one side of one end;

a compressor assembly from heel end of said neck to same end of said main frame;

a deflection bumper of sufficiently hard material at distal end of said main frame;

an anchor rod of sufficient tensile strength with one end joined at predetermined location on said eyelet side of said main frame and accommodated therein in angular configuration with respect to said main frame therewith as opposite end of said anchor rod passes through said eyelet;

a means for applying more or less pressure to said eyelet from said anchor rod;

a means for shimming the space between said main frame and said anchor rod at selected position(s).

2. The multi-action device for controlled correcting of bowing in the neck of said stringed musical instrument according to claim 1, wherein further control of correcting is made by controlled pre-stressing at predetermined locations on said main frame.

3. The multi-action device for controlled correcting of bowing in the neck of said stringed musical instrument according to claim 1, wherein further control of correcting is made by curing slots of predetermined depth and location across said main frame.

4. The multi-action device for controlled correcting of bowing in the neck of said stringed musical instrument according to claim 1, wherein further control of correcting is made by incorporating pressure points at predetermined locations on said distal end of said main frame.

5. The multi-action device for controlled correcting of bowing in the neck of said stringed musical instrument according to claim 1, wherein further control of correcting is made by use of any combination of pre-stressing, cutting slots across, and/or incorporating pressure points at predetermined locations on said distal end of said main frame.

* * * * *